US009777476B2

(12) United States Patent
Grubka

(10) Patent No.: US 9,777,476 B2
(45) Date of Patent: Oct. 3, 2017

(54) RIDGE VENT WITH FIRE RESISTANT MATERIAL

(71) Applicant: Owens Corning Intellectual Capital, LLC, Toledo, OH (US)

(72) Inventor: Lawrence J. Grubka, Westerville, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 0 days.

(21) Appl. No.: 15/152,590

(22) Filed: May 12, 2016

(65) Prior Publication Data

US 2016/0333574 A1 Nov. 17, 2016

Related U.S. Application Data

(60) Provisional application No. 62/160,058, filed on May 12, 2015.

(51) Int. Cl.

| | |
|---|---|
| ***E04D 13/17*** | (2006.01) |
| ***E04B 7/02*** | (2006.01) |
| *F24F 7/02* | (2006.01) |

(52) U.S. Cl.

CPC ..... *E04B 7/022* (2013.01); *E04D 13/174* (2013.01); *F24F 7/02* (2013.01); *F24F 2221/30* (2013.01)

(58) Field of Classification Search

CPC ..... E04B 7/022; F24F 7/02; F24F 11/0001; F24F 2221/30

See application file for complete search history.

(56) References Cited

U.S. PATENT DOCUMENTS

| | | | |
|---|---|---|---|
| 6,000,189 | A | 12/1999 | Breuer et al. |
| 6,213,868 | B1 | 4/2001 | Sells |
| 6,361,434 | B1 | 3/2002 | Brandon |
| 6,558,251 | B2 | 5/2003 | Sells |
| 7,662,037 | B2 | 2/2010 | Polston |
| D615,218 | S | 5/2010 | Grubka |
| 8,062,985 | B2 | 11/2011 | Collier et al. |
| 8,782,967 | B2 | 7/2014 | Daniels |

(Continued)

FOREIGN PATENT DOCUMENTS

| | | |
|---|---|---|
| WO | 01/04546 | 1/2001 |
| WO | 2009/140422 | 11/2009 |

OTHER PUBLICATIONS

Owens Coming brochure, VentSure 4-Foot Strip Heat & Moisture Ridge Vents Installation Instruction, 2 pgs., Feb. 2009.

(Continued)

*Primary Examiner* — Patrick J Maestri

(74) *Attorney, Agent, or Firm* — Calfee, Halter & Griswold LLP

(57) ABSTRACT

A ridge vent having a top side including a top wall with a bottom surface, a bottom side spaced apart from the top side, a side wall connecting the top side to the bottom side and an air outlet positioned in one of the top wall or the side wall. The ridge vent including a fire resistant material adjacent the bottom surface of the top wall. The ridge vent forms air flow path directing air through the vent and out of the air outlet. In a first position, the fire resistant material is not in the air flow path. In a second position, the first resistant material blocks the air flow path in response to the ridge vent being exposed to excessive heat.

18 Claims, 5 Drawing Sheets

(56) References Cited

U.S. PATENT DOCUMENTS

| | | | | |
|---|---|---|---|---|
| 2007/0014995 | A1 | 1/2007 | Chacko | |
| 2008/0220714 | A1 | 9/2008 | Caruso et al. | |
| 2009/0260303 | A1 | 10/2009 | Jensen | |
| 2009/0286463 | A1 | 11/2009 | Daniels | |
| 2010/0112932 | A1* | 5/2010 | Grubka | E04D 13/174 454/365 |
| 2011/0061318 | A1 | 3/2011 | August | |
| 2012/0073216 | A1 | 3/2012 | Daniels | |
| 2013/0118102 | A1* | 5/2013 | Pilz | E04B 1/948 52/232 |

OTHER PUBLICATIONS

Owens Corning brochure, VentSure 4-Foot Strip Heat & Moisture Ridge Vents with Weather PROtector Moisture Barrier Installation Instructions, 2 pgs., Oct. 2009.

The Unico System, Plenum Take-Off Installation Instructions, Bulletin 30-50, 2 pgs., Apr. 2006.

www.deflecto.com, one page web printout, Dryer Easy Dock, copyright 2013, printed Jun. 11, 2015.

Nyacol Nano Technologies, Inc., Flame Retardant Developments for Polypropylene, 14 pgs., printed Jan. 20, 2010 from http://www.nyacol.com.

NationalFilterSales.com, Fiberglass 8"x30"x1" Panel Filter, 2 pgs., printed Jan. 27, 2010 from http://www.nationalfiltersales.com.

Wire Cloth brochure pp. 42-49, www.directmetals.com, printed at least as early as the filing date of the subject application.

Owens Corning brochure, VentSure, 4-foot Strip Heat and Moisture Ridge Vent, 2 pgs. Jan. 2009.

Owens Corning brochure, Owens Corning BTR2, Burn-Through Resistant Material, Preliminary Technical Data Sheet, 2 pgs., printed Oct. 2009.

Brominated Flame Retardants: Cause for Concern? 3 pgs., printed Feb. 23, 2011 from http://www.greenfudge.org.

Ridge Line Ventilators, Lo-OmniRidge, Lomanco, Inc., LoProfile Shingle-Over Ridge Vent brochure, 3 pgs., date is at least as early as the filing date of the subject application.

Cleveland Wire Cloth & Manufacturing Company, Woven Wire Cloth, Specifications and Technical Information brochure, 31 pgs., date is at least as early as the filing date of the subject application.

* cited by examiner

RIDGE VENT WITH FIRE RESISTANT MATERIAL

CROSS-REFERENCE TO RELATED APPLICATIONS

The present application claims the benefit of U.S. Provisional Patent Application Ser. No. 62/160,058, filed on May 12, 2015, the disclosure of which is incorporated herein by reference in its entirety.

FIELD OF THE INVENTION

The present application generally relates to ridge vents and, more particularly, to ridge vents with fire resistant material.

BACKGROUND OF THE INVENTION

Buildings, such as for example residential buildings, are often covered by a sloping roof deck. The interior portion of the building located directly below the sloping roof deck forms a space called an attic. Attics are often ventilated to help prevent the formation of condensation or buildup of excess heat. One example of a method of ventilating an attic includes positioning one or more ridge vents over an elongated opening at the roof ridge. The ridge vents can cooperate with eave vents, positioned in the eaves, to allow air to enter the eave vents, travel up through the attic and exit through the ridge vents.

SUMMARY

In accordance with embodiments of this invention, there are provided ridge vents with fire resistant material configured to cover an open ridge of a roof. A ridge vent having a top side including a top wall with a bottom surface, a bottom side spaced apart from the top side, a side wall connecting the top side to the bottom side and an air outlet positioned in one of the top wall or the side wall. The ridge vent including a fire resistant material adjacent the bottom surface of the top wall. The ridge vent forming an air flow path that directs air through the ridge vent and out of the air outlet. In a first position, the fire resistant material is not in the air flow path. In a second position, the first resistant material blocks the air flow path in response to the ridge vent being exposed to excessive heat.

Various objects and advantages will become apparent to those skilled in the art from the following detailed description of the invention, when read in light of the accompanying drawings. It is to be expressly understood, however, that the drawings are for illustrative purposes and are not to be construed as defining the limits of the invention.

BRIEF DESCRIPTION OF THE DRAWINGS

The accompanying drawings, which are incorporated in and constitute a part of this specification, illustrate some embodiments disclosed herein, and together with the description, serve to explain principles of the embodiments disclosed herein.

DETAILED DESCRIPTION OF THE INVENTION

The embodiments disclosed herein will now be described by reference to some more detailed embodiments, in view of the accompanying drawings. These embodiments may, however, be embodied in different forms and should not be construed as limited to the embodiments set forth herein. Rather, these embodiments are provided so that this disclosure will be thorough and complete, and will fully convey the scope of the inventions to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

As used in the description of the invention and the appended claims, the terms "top", "bottom", "upper", and "lower", when used regarding the ridge vent, roofing material, or the roof, are in reference to the ridge vent and roofing material when installed on a roof or the roof relative to the building structure. "Bottom" referring to the portion facing towards the roof or building and "top" referring to the portion facing away from the roof or building.

Figure 1:
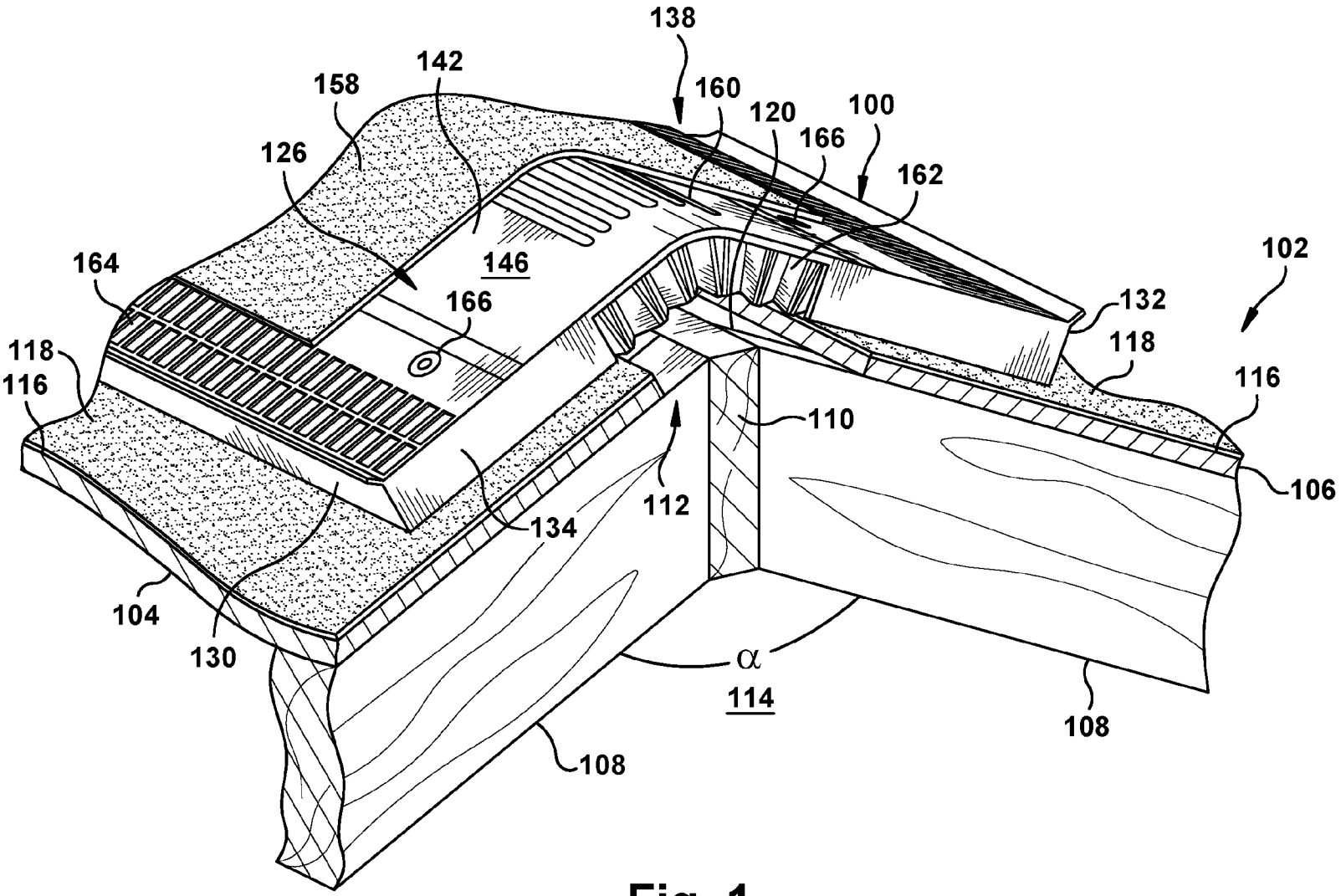
FIG. 1 is a partial perspective view of an exemplary embodiment of a ridge vent shown installed on a portion of a roof.
Figure 2:
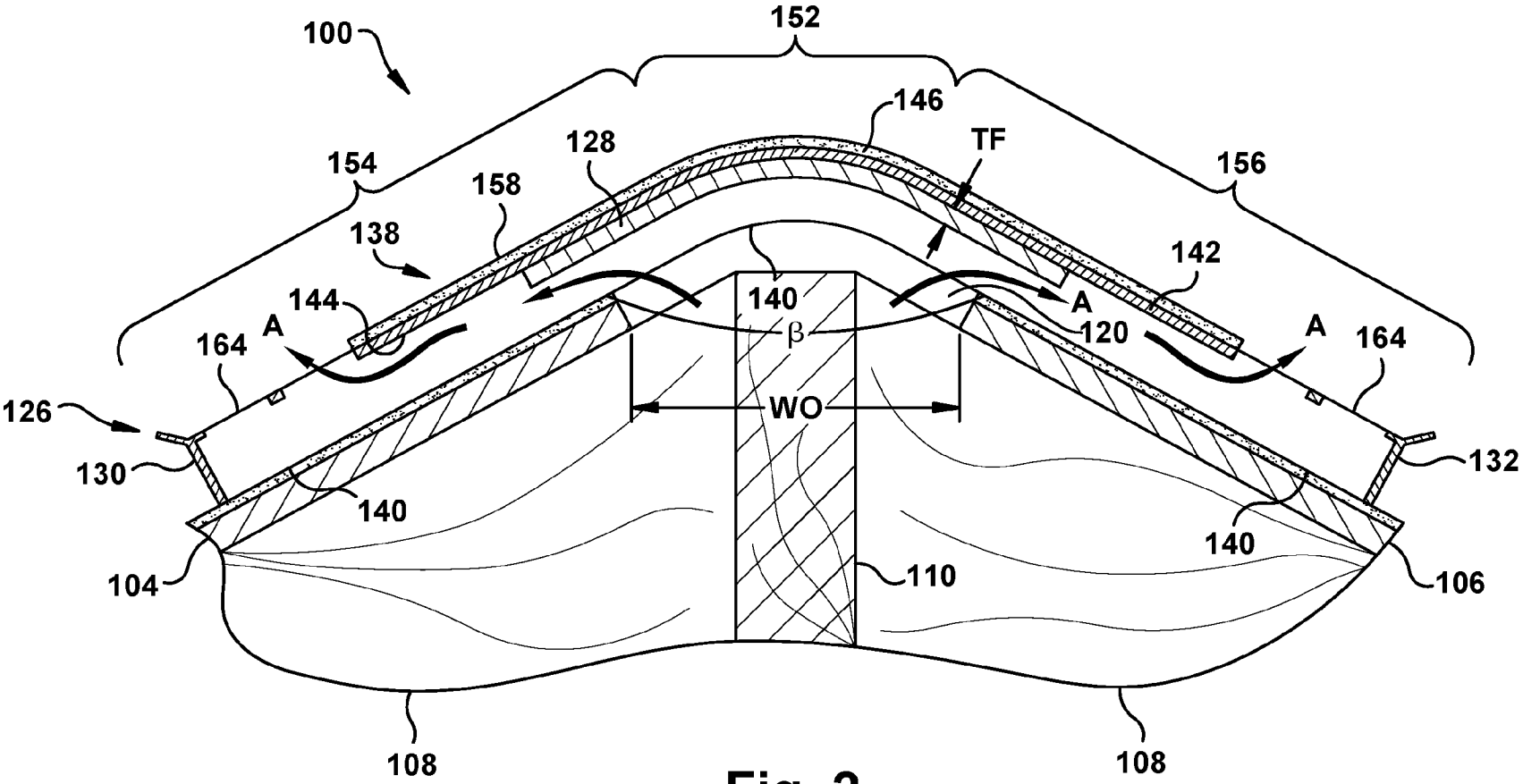
FIG. 2 is a front sectional view of the ridge vent of FIG. 1 shown installed on a portion of a roof with fire resistant material in a first position.
Figure 3:
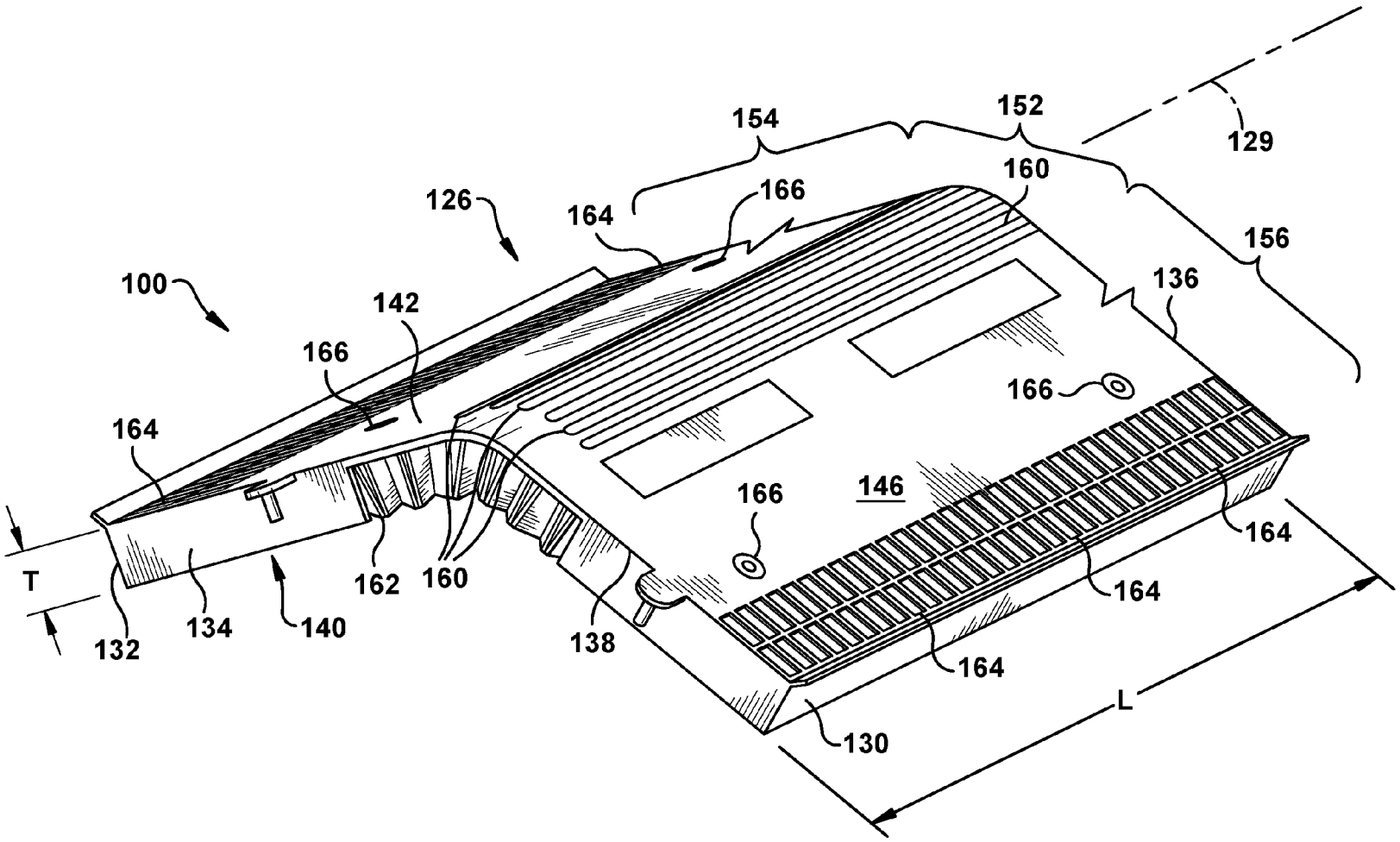
FIG. 3 is a partial perspective view of the ridge vent if FIG. 1 illustrated in the flexed position.

Referring to FIGS. 1 and 2, an exemplary embodiment of a ridge vent 100 is shown. Generally, the ridge vent 100 is designed to be mounted onto a roof 102 of a building. The roof 102 includes a first roof plane 104 and an opposing second roof plane 106. The roof planes can be made of a wood-based material, including, but not limited to oriented strand board or plywood. In other embodiments, the roof planes 104, 106 can be other desired materials.

Supporting the roof planes 104, 106 are a series of generally parallel, spaced apart rafters 108 or trusses, depending on the type of roof (in FIG. 1, only one rafter 108 is shown for each of the roof planes, 104 and 106). In the illustrated embodiment, the rafters 108 are connected at one end to a ridge board 110 defining the ridge 112 of a building and at the other end to a wall (not shown). In other embodiments, the ends of the rafters 108 can be connected to other desired components or structures. In the illustrated embodiment, the rafters 108 and the ridge board 110 are made from framing lumber, having sizes including, but not limited to 2 inches thick by 10 inches wide. In other embodiments, however, the rafters 108 and the ridge board 110 can be made from other desired materials and have other desired sizes.

The first and second roof planes, 104 and 106, intersect with the ridge board 110 thereby forming slope angle $\alpha$. In the illustrated embodiment, the slope angle $\alpha$ is 120 degrees or approximately 120 degrees. In other embodiments, however, the slope angle $\alpha$ can be more or less than 120 degrees.

The top surface 116 of the roof planes 104, 106 supports a plurality of shingles 118. The shingles 118 may be attached to the top surface 116 of the roof planes 104, 106 in a variety of ways, including but not limited to, any desired fasteners, including roofing nails (not shown). It should be understood that the shingles 118 can be any desired roofing material, such as, but not limited to, asphalt-based, ceramic, and wood shingles.

In the exemplary embodiment, under the roof planes 104, 106 is an attic space 114. A ridge opening 120 is formed between the roof planes 104, 106 at the ridge 112 of the roof 102. The ridge opening 104 may extend along the entire ridge 102 or a portion of the ridge and allows a flow of air to travel through the attic space 114 and exit the attic through the ridge opening 120. As shown in FIG. 2, the ridge opening 120 has a width WO. The ridge opening width WO may vary in different applications. In one exemplary embodiment, the ridge opening 120 width is in the range of 1.5 to 2.5 inches While the ridge opening 120 shown in FIGS. 1 and 2 is formed by the structure of the rafters 108, the ridge board 110 and the roof planes 104, 106, it should be understood the ridge opening 120 can be formed by other structures or combinations of structures.

When installed on the roof 102, the ridge vent 100 is positioned at the ridge 112 on top of the roof planes 104, 106 opposite the attic space 114 and spans the ridge opening 120. The ridge vent 100 is designed to route air from the attic 114 to an area exterior to the building while providing a barrier to resist undesirable material or particles entering the attic 114 via the ridge opening 120.

FIGS. 1-4 show an exemplary embodiment of the ridge vent 100 having a ridge vent body 126 and a fire resistant material 128 capable of covering the ridge opening 120. The ridge vent body 126 may be, or may include elements of, the ridge vent disclosed in U.S. Published Patent Application 2001/0112932, the entire disclosure of which is incorporated herein by reference.

The ridge vent 100 may be configured in a variety of ways. Any configuration capable of spanning the ridge opening 120, routing air from the attic space 114 to an area exterior to the building and including a fire resistant material 128 capable of covering the ridge opening may be used. For example, different embodiments of the ridge vent 100 may have different shapes, different sizes (length, width, and thickness), be made of different materials, have air flow paths configured differently and include various other structure, such as for example, baffles, vanes, pins, or other structures. The ridge vent 120 may be made from any suitable material or combination of materials. In the illustrated embodiment, the ridge vent 100 is made of a polypropylene material. In other embodiments, however, the ridge vent 100 can be made of other suitable materials, such as for example, metal or any suitable polymeric material.

In the illustrated exemplary embodiment, the ridge vent body 126 is generally box-shaped and extends along a longitudinal axis 129. The body 126 includes a first side wall 130, a second side wall 132 spaced apart from and parallel, or generally parallel, to the first side wall, a third side wall 134 extending between and connecting the first side wall to the second side wall, and the fourth side wall 136 spaced apart from and parallel, or generally parallel, to the third side wall and extending between and connecting the first side wall to the second side wall. The body 126 has a length L, and width W, and a thickness T. In the illustrated embodiment, the length L is 48 inches, or approximately 48 inches, and the thickness is 1.0 inches, or approximately 1.0 inches. In other embodiments, however, the length L of the ridge vent 100 can be more or less than approximately 48 inches and the thickness T can be more or less than approximately 1.0 inches.

The body 120 includes a top side 138 and a bottom side 140, opposite of and spaced apart from the top side. The top side 138 includes a top wall 142 having a bottom surface 144 that faces the bottom side 140 and a top surface 146 that faces away from the bottom surface. The bottom side 140 is at least partially open or includes an opening that functions as an inlet for air entering the roof vent, such as for example, from the attic via the ridge opening 120. In the illustrated embodiment, the entire bottom side 140 is open. In other embodiments, however, only a portion of the bottom side 140 is open (i.e. a large enough opening to suitably function as an air inlet).

In the illustrated exemplary embodiment, the ridge vent 100 includes a center portion 152, a left portion 154 and a right portion 156. The center portion 152 of the ridge vent 100 is configured to flex, thereby allowing the left portion 154 and the right portions 156 to form a ridge vent angle β. The ridge vent angle is configured to allow at least a portion of the bottom side 140 of the left and right portions 154, 156, to seat against the first and second roof planes 104,106. In the illustrated embodiment, the ridge vent angle β is the same angle as the slope angle α formed by the opposing rafters 108. In other embodiments, however, the ridge vent angle β can be other angles suitable to allow the bottom at least a portion of the bottom side 140 of the left and right portions, 154 and 156, to seat against the first and second roof planes, 104 and 106. The left and right portions, 154 and 156, of the ridge vent 100 are fastened to the roof planes, 104 and 106 by any suitable method of attachment, such as for example, by fasteners, adhesive, hook and loop connectors or other suitable means. At least a portion of the top surface 146 of the top wall 142 is covered by a row of vent shingles 158.

The center portion 152 includes a plurality of optional grooves 160. Generally, the grooves 160 are configured to provide sufficient flexibility to the center portion 152 to allow the ridge vent 100 to flex in a direction generally perpendicular to the length L of the ridge vent, while also providing structural reinforcement to the center portion 152. The combination of flexibility and structural reinforcement provided by the grooves 160 allows a controlled curvature of the ridge vent 100 as the ridge vent is flexed. The controlled curvature provides the flexed ridge vent 100 with a smooth curvature when installed on a roof. However, configuring the ridge vent 100 to include the grooves 160 is optional and not necessary for the use of the ridge vent.

In the illustrated embodiment, the center portion 152 of the ridge vent 100 includes a flex portion 162. The flex portion 162 is configured to easily bend when the ridge vent 100 is flexed. The flex portion 162 may be configured in a variety of ways. The flex portion 162 may be, for example but not limited to, an accordion-style wall portion or a group of nested projections (as disclosed in U.S. Published Patent Application 2001/0112932).

One or more air outlets 164 are formed in at least one of the top wall 142, the first side wall 130, the second side wall 132, the third side wall 134, or the fourth side wall 136. In the illustrated embodiment, the air outlets 164 are formed as a plurality of louvers through the top wall 142 adjacent the first side wall 130 and the second side wall 132. In the illustrated embodiment, the air outlets 164 are arranged in a column and row configuration having a quantity of two columns and rows extending substantially along the length L of the ridge vent 100. In other embodiments, the air outlets 164 can be configured and arranged in other desired configurations. In the illustrated embodiment, the air outlets 164 have a square shape and are positioned such that an outward column is substantially adjacent an first sidewall 130 and the second sidewall 132. In other embodiments, the air outlets 164 can be positioned in other desired locations sufficient and can have other shapes, including, but not limited to round or hexagonal shapes, sufficient to allow the flow of air to exit the ridge vent 10 through the air outlets 164.

Figure 4:
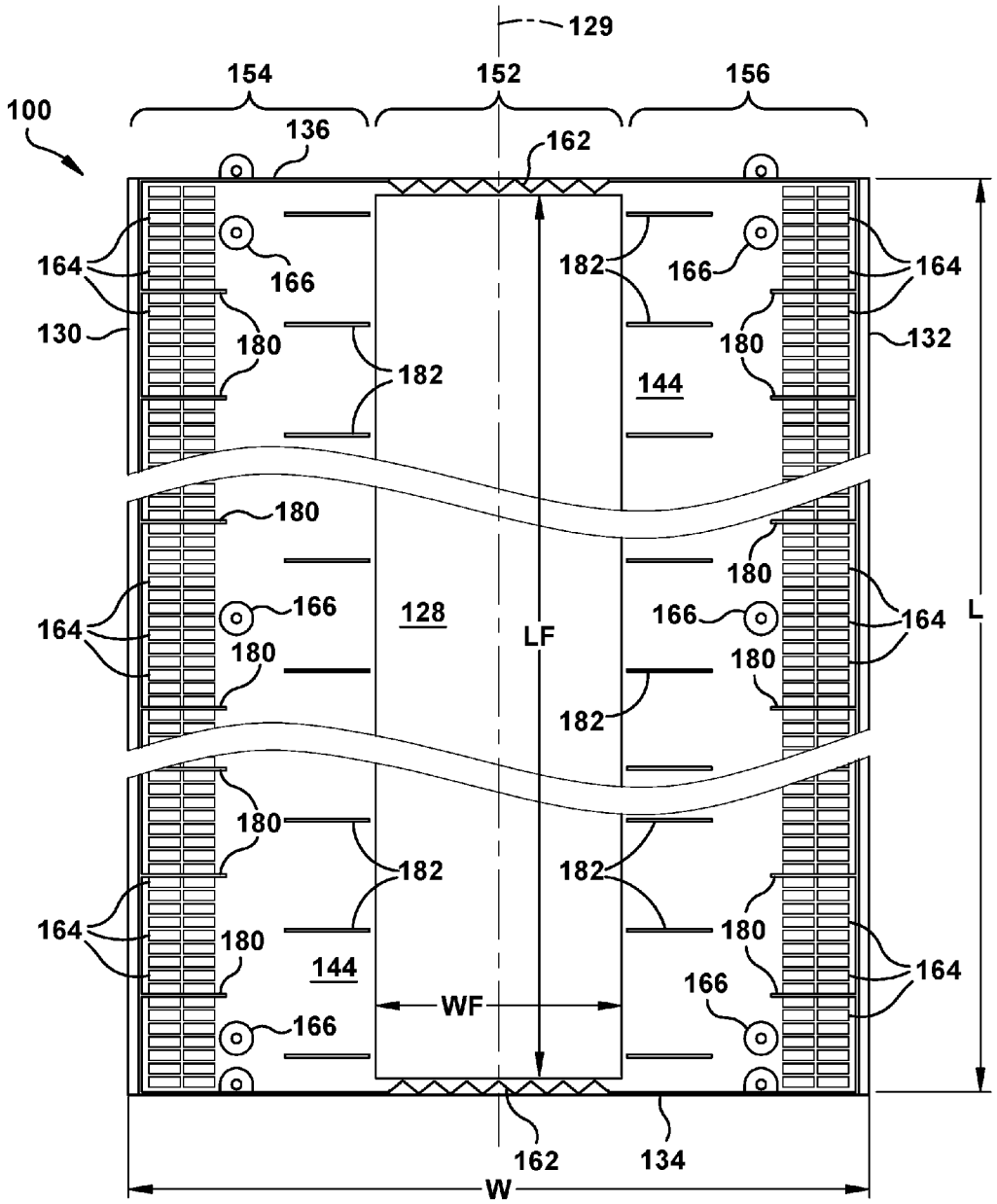
FIG. 4 is a bottom view of the ridge vent of FIG. 1.

Referring now to FIG. 4, the ridge vent 100 has an un-flexed width W extending from the first sidewall 130 to the second sidewall 132. In the illustrated embodiment, the width W is 14.35 inches, or approximately 14.35 inches. In other embodiments, however, the width W can be more or less than approximately 14.35 inches.

The ridge vent 10 may include a plurality of fastening apertures 166, positioned in the left and right portions, 154 and 156, and spaced apart along the length L of the ridge vent 100. The fastening apertures 166 are configured to receive fasteners, such as for example, nails for attaching the ridge vent 100 to the roof 102.

Referring again to FIG. 4, the exemplary embodiment of the ridge vent 100 includes a plurality of edge baffles 180 and a plurality of interior baffles 182. In other embodiments, however, the ridge vent 100 may not include any edge or interior baffles. The edge baffles 180 extend in a direction that is generally perpendicular to either first sidewall 130 or the second sidewall 132, toward the center portion 152 of the ridge vent 100. The edge baffles 180 are configured to provide structural support to the first sidewall 130 and the second sidewall 132, as well as providing structural support to the areas of the left and right portions, 154, 156, in which the outlets 164 are positioned. The edge baffles 180 may have varying lengths or may all have the same length.

The interior baffles 182 are oriented in a direction that is generally perpendicular to either first sidewall 130 or the second sidewall 132 and extend in a line along the length L of the ridge vent 100. The interior baffles 182 are positioned inward from the outlets 164 and are configured to provide structural support to the left and right portions, 154 and 156. While the interior baffles 182 in the illustrated embodiment are all shown to have the same length, in other embodiments the the interior baffles can have varying lengths.

In the illustrated embodiment the edge baffles 180 and interior baffles 182 are straight members that are oriented to be substantially perpendicular to either the first sidewall 130 or the second sidewall 132, In other embodiments, however, the edge baffles 180 and interior baffles 182 may be curved members, have curved portions and be oriented at any desired angle to the either the first sidewall 130 or the second sidewall 132.

The fire resistant material 128 is positioned relative to the ridge vent body 126 and the ridge opening 120 in a first position in which the fire resistant material is not within the air flow path through the ridge vent 100 (i.e. air flows around or past the fire resistant material, not through the fire resistant material) and a second position in which the fire resistant material blocks the ridge opening. The fire resistant material 128 may be configured and arranged in a variety of ways. For example, any material, or combination of materials, capable of blocking the ridge opening 120 to prevent flames and flowing molten plastic from entering the ridge opening may be used. The fire resistant material 128 may block the ridge opening 120 in any suitable manner. For example, in the second position, the fire resistant material 128 may be positioned such that it contacts the roof deck 116, or the shingles 118 on the roof deck, on either side of the ridge opening 120. In this manner, the fire resistant material 128 spans across the ridge opening 120 and the contact points between the fire resistant material 128 and the upper surface of the roof block flames and flowing molten plastic from entering the ridge opening.

The fire resistant material 128 may include be a wide variety of different materials. In one exemplary embodiment, the fire resistant material is a flexible composite multiple layer fire-resistant insulation structure as disclosed in U.S. Pat. No. 8,062,985, issued to Collier et al., the entire disclosure of which is incorporated herein by reference. Other non-limiting examples of suitable fire resistant material include FR-10 and FR-50 Fire Retardant Slipsheet from Atlas Roofing Corporation, Fire Retardant Glass Veil from Owens-Corning Corporation, or a metal shim material. In addition, any orientation or position relative to the ridge vent body 126 and the ridge opening 120 in which the fire resistant material is not within the air flow path through the ridge vent 100 while in a first position and blocks the ridge opening in a second position may be used.

In the illustrated embodiment, the fire resistant material 128 is layer or blanket of the flexible composite multiple layer fire-resistant insulation disclosed in U.S. Pat. No. 8,062,985 positioned adjacent the bottom surface 144 of the top wall 142. In one exemplary embodiment, the fire resistant material 128 is a fire resistant blanket connected or attached to the bottom surface 144. The fire resistant material 122 maybe connected or attached to the bottom surface 144 by any suitable means, such as for example, by an adhesive, by mechanical connectors, by heat welding, or by a friction fit. In the exemplary embodiment, the fire resistant material 128 is heat welded to the bottom surface 144 of the top wall 142

The fire resistant material 128 may have a width WF, a length LF, and a thickness TF. The width WF is selected to be greater than the ridge opening width WO. In one exemplary embodiment, the fire resistant material 128 extends across the entire, or nearly the entire, center portion 152. In another exemplary embodiment, the fire resistant material 128 is positioned inward of the interior baffles 182 in the left portion 154 and inward of the interior baffles 182 in the right portion 156. In other embodiments, however, the fire resistant material 128 may extend the entire distance from the outlets 164 in the left portion 154 to the outlets 164 in the right portion 156. Still in other embodiments, the fire resistant material 128 may overlap at least a portion of the outlets 128. In some embodiments, the fire resistant material 128 extends around the interior baffles 182. For example, the interior baffles 182 may extend through the fire resistant material 128. In one exemplary embodiment, the ridge opening has a width WO of about 1½ to 2½ inches and the fire resistant material has a width WF greater than the width WO, such as for example, about 3 to 5 inches. In one exemplary embodiment and the ridge opening has a width WO of about 2 inches and the fire resistant material has a width WF of 3¾ inches, or about 3¼ inches.

The fire resistant material 128 may extend the entire distance, or nearly the entire distance, between the third side wall 134 and the fourth side wall 136. Thus, the length LF of the fire resistant material 128 may be equal to, or within a few inches of, the length L of the ridge vent body 120. Preferably, the fire resistant material 128 will cover the length, or about the length, of the ridge opening 120 being overlaid by the ridge vent 100. In other embodiments, however, the length LF of the fire resistant material 128 may be less than the length L of the ridge vent body 120. In some embodiments, the thickness TF of the fire resistant material 128 is less than the thickness T of the ridge vent body 120. In other embodiments, however, the thickness TF of the fire resistant material 128 may be equal to or greater than the thickness of the ridge vent body 120.

In use, the ridge vent 100 is installed over the ridge opening 120. The ridge vent 100 is flexed, forming the ridge vent angle between the left and right portions 154, 156, positioned over the ridge opening 12 and secured in place onto the roof 102 by any suitable means, such as for example by attaching the left and right portions 154, 156, to the first and second roof planes 104 and 106, respectively by various fasteners such as nails, by adhesives, or by another suitable manner of attachment. Subsequent ridge vents 100 can be installed in series along the ridge 112 until the ridge opening 120 is completely covered. The ridge vent shingles 158 are installed, in an overlapping manner, over the installed ridge vents 100.

When installed over the ridge opening 120, an air flow path A is formed as shown by the arrows in FIG. 2. In particular, air from the attic space 114, exits the attic through the ridge opening 120, and flows into the open bottom side 140 of the ridge vent 100. The ridge vent 100 diverts the air outward along the ridge vent body 126 toward the first side wall 130 and second side wall 132 and out of the outlets 164. The fire resistant material 128 is in the first position which is out of the air flow path A and adjacent the bottom surface 144 of the top wall 142. Thus, the air flow path A, in the exemplary embodiment, is between the bottom side 140 of the ridge vent 100 and the top wall 142, which has the fire resistant material 126.

Figure 5:
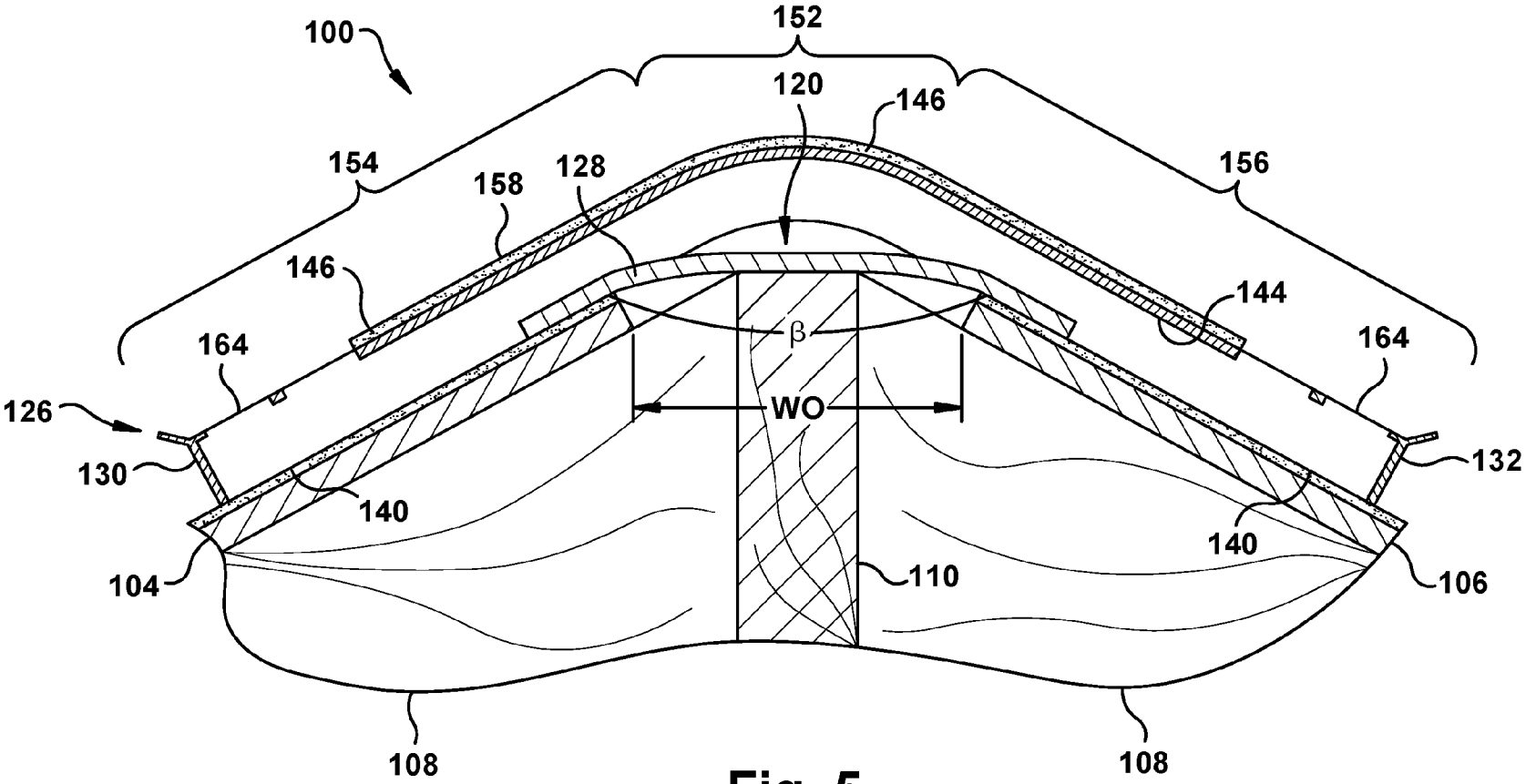
FIG. 5 is a front sectional view of the ridge vent of FIG. 1 shown installed on a portion of a roof with fire resistant material in a second position.

The ridge vent 100 may be configured such that when the ridge vent is exposed to sufficient heat, such as for example, extreme heat caused by a fire, the fire resistant material 128 will move to the second position and block the ridge opening 120, as shown in FIG. 5. The ridge vent 100 may be configured such that the exposure to sufficient heat may cause the fire resistant material 128 to cover the ridge opening 120, or otherwise block the airflow path A, in a variety of ways. In one exemplary embodiment, the excess heat may plastically deform or melt the ridge vent body 126, or a portion of the vent body. For example, portions of the ridge vent body, such as one or more of the sidewalls 130, 132, 134, 136, may be configured to plastically deform or melt resulting in the sidewalls buckling or the ridge vent body collapsing and the top wall 142 and the fire resistant material 128 dropping downward under the force of gravity such that the fire resistant material covers the ridge opening 120.

In one exemplary embodiment, the fire resistant material 128 will move to the second position and block the ridge opening 120 when at least a portion of the ridge vent 120 exceeds the melting temperature of at least one material included in the ridge vent. For example, in one embodiment, sufficient heat refers to heat above the melting point of polypropylene (266° F. to 340° F.).

The ridge vent body 126 may also, or alternatively, be configured such that the fire resistant material 128 is released from its connection to the bottom surface 144 of the top wall 140. Any type of connection capable of releasing the fire resistant material 128 may be used. For example, the connection between the fire resistant material 128 and the vent body 126 may melt or plastically deform such that fire resistant material is released from the top wall 142 and drops downward covering the ridge opening 120. In another exemplary embodiment, the fire resistant material 128 may be attached to the top wall 142 via an adhesive. The adhesive may be designed to release the fire resistant material 128 when exposed to excessive heat prior to any plastic deformation or melting of the ridge vent body 126.

In one exemplary embodiment, the ridge vent 100, as described above, passes Class A fire testing criterion for roofing systems at Underwriters Laboratories (UL).

The above description of specific embodiments has been given by way of example. From the disclosure given, those skilled in the art will not only understand the general inventive concepts and attendant advantages, but will also find apparent various changes and modifications to the structures and methods disclosed. For example, the general inventive concepts are not limited to ridge vents but may be applied to any application in which covering an opening with fire resistant material after the material or the carrier of the material has been exposed extreme heat or fire. It is sought, therefore, to cover all such changes and modifications as fall within the spirit and scope of the generally inventive concepts, as described and claimed herein, and equivalents thereof.

The invention claimed is:

1. A ridge vent for covering an opening at the ridge of a roof, the ridge vent comprising:
- a top side including a top wall with a bottom surface,
- a bottom side spaced apart from the top side,
- a side wall connecting the top side to the bottom side;
- an air outlet positioned in one of the top wall or the side wall; and
- a fire resistant material, containing glass fibers, adjacent the bottom surface of the top wall;
- wherein the ridge vent forms an air flow path between the bottom side and the fire resistant material to direct air through the vent and out of the air outlet when the fire resistant material is in a first position.

2. The ridge vent of claim 1 wherein, in a second position, the fire resistant material blocks the air flow path in response to the ridge vent being exposed to excessive heat.

3. The ridge vent of claim 2 wherein excessive heat is heat exceeding at least 260 deg. F.

4. The ridge vent of claim 2 wherein excessive heat is heat exceeding the melting point of polypropylene.

5. The ridge vent of claim 1 wherein the fire resistant material is a flexible composite multiple layer fire-resistant insulation blanket.

6. The ridge vent of claim 1 wherein the fire resistant material forms a blanket having a width in the range of 3 to 5 inches.

7. The ridge vent of claim 1 wherein the ridge vent is made from polypropylene and the fire resistant material is attached to the bottom surface of the top wall by heat welding.

8. A vent installation comprising:
- a roof having a ridge opening with a first width;
- a ridge vent including:
  - a ridge vent body having a top wall; and
  - a fire resistant blanket, containing glass fibers, adjacent the top wall and positioned above the ridge opening, the fire resistant material having a second width that is greater than the first width;
  - wherein, in a first position, the fire resistant blanket is adjacent an air flow path formed through the vent body.

9. The vent installation of claim 8 wherein the fire resistant material moves to a second position that covers the ridge opening when the ridge vent is exposed to heat exceeding at least 260 deg. F.

10. The vent installation of claim 9 wherein the fire resistant material moves to a second position that covers the ridge opening when the ridge vent is exposed to heat exceeding the melting point of polypropylene.

11. The vent installation of claim 8 wherein the ridge vent is UL Class A fire rated.

12. A method of venting an attic and protecting the attic from exposure to fire, comprising:

installing a ridge vent having a fire resistant material over an opening at the ridge of a roof covering the attic; wherein the ridge vent includes a top wall spaced apart from the opening at the ridge and the fire resistant material is attached to the top wall, routing air from the attic through ridge vent; and covering the opening with the fire resistant material by lowering the fire resistant material onto the opening under the force of gravity in response to the ridge vent being exposed to excessive heat.

13. The method of claim 12 wherein covering the opening with a fire resistant material further comprising melting or plastically deforming at least a portion of the ridge vent.

14. The method of claim 12 wherein excessive heat is heat exceeding at least 260 deg. F.

15. The method of claim 12 wherein the ridge vent includes a top wall spaced apart from the ridge opening and the fire resistant material is attached to the top wall.

16. A method of venting an attic and protecting the attic from exposure to fire, comprising:

installing a ridge vent having a fire resistant material over an opening at the ridge of a roof covering the attic;

routing air from the attic through ridge vent; and covering the opening with the fire resistant material in response to the ridge vent being exposed to excessive heat, wherein the ridge vent includes a top wall spaced apart from the ridge opening and the fire resistant material is attached to the top wall, and wherein covering the opening with a fire resistant material further comprising detaching the fire resistant material from the top wall.

17. The method of claim 12 wherein covering the opening with the fire resistant material blocks fire and molten plastic from entering the opening in the ridge.

18. The method of claim 12 wherein the fire resistant material contains glass fibers.

* * * * *